United States Patent [19]

Grabbe et al.

[11] Patent Number: 4,737,120

[45] Date of Patent: Apr. 12, 1988

[54] ELECTRICAL CONNECTOR WITH LOW INSERTION FORCE AND OVERSTRESS PROTECTION

[75] Inventors: Dimitry G. Grabbe, Middletown; Iosif Korsunsky, Harrisburg, both of Pa.

[73] Assignee: AMP Incorporated, Harrisburg, Pa.

[21] Appl. No.: 926,547

[22] Filed: Nov. 12, 1986

[51] Int. Cl.[4] ..... H01R 9/09

[52] U.S. Cl. ..... 439/326; 439/328; 439/636; 439/856

[58] Field of Search ..... 339/258 R, 258 P, 176 MP, 339/75 MP, 91 R; 439/325–328, 629–637, 856, 858, 861, 862

[56] References Cited

U.S. PATENT DOCUMENTS

| | | | |
|---|---|---|---|
| Re. 26,692 | 10/1969 | Ruehlemann | 339/258 P |
| 3,199,066 | 8/1965 | Eledge et al. | 339/176 MP |
| 3,601,775 | 8/1971 | Longenecker et al. | 339/258 P |
| 3,631,381 | 12/1971 | Pittman | 339/176 MP |
| 3,732,531 | 5/1973 | Bouley | 339/258 R |
| 3,795,888 | 3/1974 | Nardo et al. | 339/176 MP |
| 3,848,952 | 11/1974 | Tighe, Jr. | 339/91 R |
| 3,920,303 | 11/1975 | Pittman et al. | 339/91 R |
| 4,136,917 | 1/1979 | Then et al. | 339/17 L |
| 4,172,626 | 10/1979 | Olsson | 339/17 F |
| 4,185,882 | 1/1980 | Johnson | 339/176 MP |
| 4,431,252 | 2/1984 | Cairns et al. | 339/176 MP |
| 4,557,548 | 12/1985 | Thrush | 339/258 P |
| 4,558,912 | 12/1985 | Coller et al. | 339/64 M |
| 4,575,172 | 3/1986 | Walse et al. | 339/75 MP |

FOREIGN PATENT DOCUMENTS 1129580 5/1962 Fed. Rep. of Germany ... 339/258 R

*Primary Examiner*—John McQuade

*Attorney, Agent, or Firm*—Bruce J. Wolstoncroft

[57] ABSTRACT

The invention is directed to an electrical connector (2) for electrically connecting contact surfaces (74) of a daughter board (18) to contact areas (46) of mother board (34). The connector (2) has contacts (36) positioned therein, the connector (2) having posts (38) which extend from the connector (2) and make electrical engagement with contact areas (46) of the mother board (34). The daughter board (18) is then inserted into the connector (2) under reduced or zero insertion force conditions and rotated to its operating position. As this rotation occurs, contact projections (60, 72) of the contacts (36) engage the contact surfaces (74) of the daughter board (18). The rotation is translated into a positive wiping action between the contact projections (60, 72) and the contact surfaces (74), thereby ensuring that a positive electrical connection is effected. The resilient nature of the contacts (36) ensures that this wiping action occurs under normal force conditions. The configuration and characteristics, i.e. the low spring rate of the spring portion (68), allow the contacts (36) to be used many times without taking a permanent set, thereby ensuring that a positive electrical connection is effected with each use. To prevent the daughter board (18) from warpage and bowing during use, a support member (88) is provided which cooperates with the board (18). The support member (88) not only maintains the board (18) in proper position, but also acts as a shielding member if required.

16 Claims, 6 Drawing Sheets

ELECTRICAL CONNECTOR WITH LOW INSERTION FORCE AND OVERSTRESS PROTECTION

FIELD OF THE INVENTION

The present invention relates to electrical connectors and more particularly to zero or low insertion force connectors that make electrical connection between printed circuit boards.

BACKGROUND OF THE INVENTION

Low insertion force electrical connectors for making electrical connection between printed circuit boards are well known in the industry. Examples of these types of connector are disclosed in U.S. Pat. Nos. 3,795,888 3,848,952; 3,920,303; 4,136,917; 4,185,882; 4,575,172. The connectors disclosed in these patents are of the type which have a pair of spring contacts which allow insertion of printed circuit boards into contact areas of the connectors under low insertion force conditions.

The prior art connectors in general, and U.S. Pat. No. 4,575,172 in particular, have been able to provide a low insertion force connection in many instances. However, the prior art lacks the ability to provide a positive wiping action to ensure a positive electrical connection when a film has built up on either the printed circuit board or the contacts or both.

The contacts of the prior art connectors also have a steep force/deflection curve. Thus, the spring contacts can take a permanent set as the contacts are displaced only a small amount. Therefore, the contacts will take a permanent set after a wide daughter board has been inserted into the connector. This permanent set of the contacts makes the connector ineffective when a relatively narrow board is subsequently inserted. The contacts do not make electrical connection with the contact areas of the daughter board resulting in an unreliable and ineffective electrical connection between the daughter board and the contacts of the connector, rendering the connector effectively useless.

Another problem with the contacts disclosed in the above listed patents is that although the contact itself uses little material, the support means for the contact, i.e. the retaining means requires a relatively large amount of material. Therefore, connecting the contact to the housing in the manner described in the prior art increases the amount of material required to manufacture the contact assembly. Thus, not only has the reliability of the connection presented problems, the price of the connector has also been kept relatively high because of the material needed for manufacture.

SUMMARY OF THE INVENTION

This invention is directed to an electrical connector for electrically connecting contact areas of a daughter board to contact areas of a mother board. The connector is comprised of a housing member, of the appropriate dielectric material, and a plurality of contacts, the housing member comprising an elongated base having a top surface and a bottom surface.

Extending from the top surface from proximate the ends thereof are securing members. The securing members cooperate with the daughter board such that when the daughter board reaches the final position, the securing members latch the daughter board in place.

Contact receiving cavities are provided in the base and extend from the top surface to proximate the bottom surface. The contacts are positioned in the cavities and have first and second sections, each section having contact projections thereon which cooperate with contact areas of the daughter board to provide electrical connection between the contacts and the daughter board. Securing projections of the contacts cooperate with the walls of the cavities and projections thereof to secure the contacts in the cavities.

It is an object of this invention to provide a reliable electrical connection between the daughter board and the mother board. This connection must be maintained as the connector is exposed to temperature variations.

It is a further object of the present invention to provide a contact which can be manufactured using minimum material. The small area of the contacts causes the contacts to have a small capacitance, which is important when high speed signals are used. The configuration of the contact must, therefore, provide the required resilient characteristics while using a minimum amount of material to do so. To do this the contact must have a low spring rate which requires that the contact have a shallow force/deflection curve. This allows the contacts to have a large tolerance to the thickness of the daughter board, preventing the resilient contacts from taking a permanent set.

As the contacts are manufactured using minimum material, it is a further object of the invention to have each section of the contact to behave independently of the other sections. Pivot zones permit individual portions of the contacts to be displaced in opposite directions relative to each other at the same time.

It is a further object to provide a connector which allows the daughter board to be inserted at an inappropriate angle without damaging the contacts. In order to accomplish this the contacts are provided with integral overstress members which limit deflection of the contacts, thus preventing them from taking a permanent set, which if present, would render the contact unreliable.

DETAILED DESCRIPTION OF THE INVENTION

Figure 1:
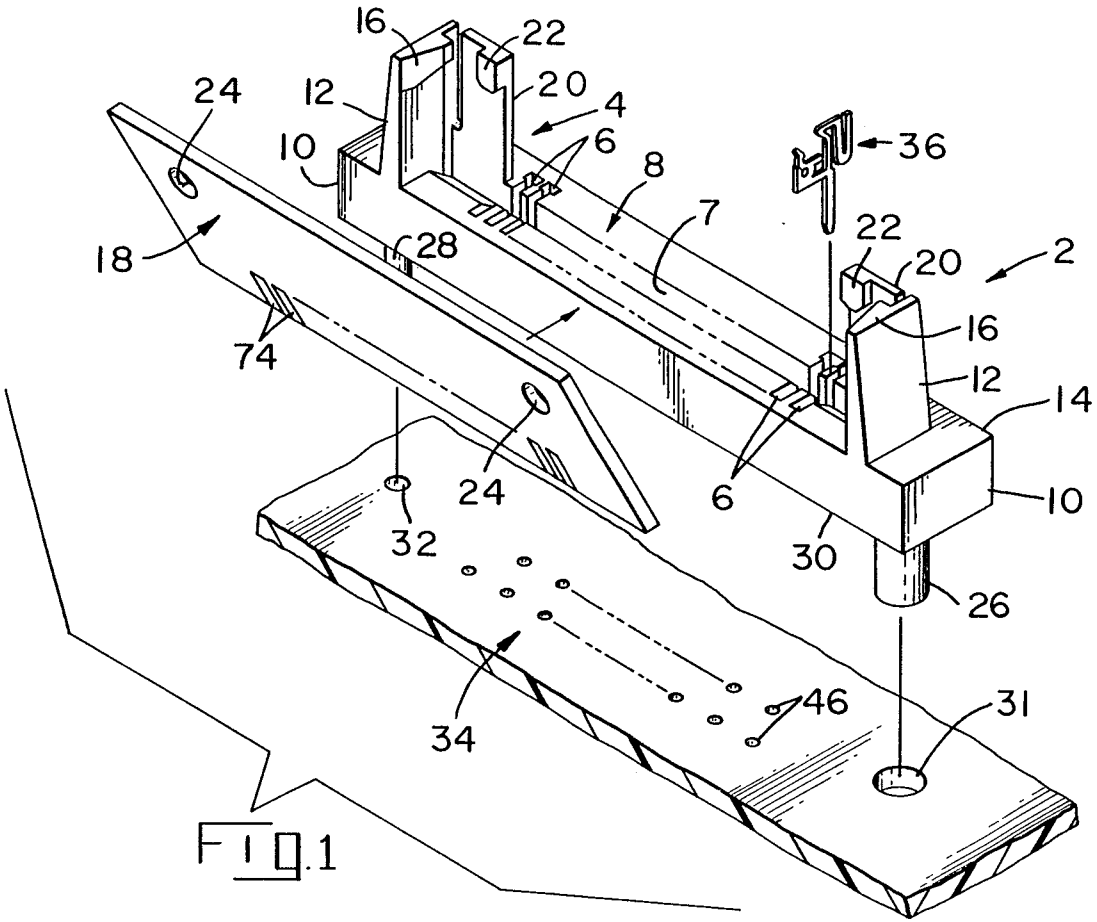
FIG. 1 is an exploded perspective view of a connector of the present invention.

Referring to FIG. 1, there is illustrated a low insertion force electrical connector 2 according to the present invention. Connector 2 electrically and mechanically connects two circuit panels together as needed.

Connector is comprised of an elongated housing 4 having a plurality of contact receiving cavities 6 located in an elongated base 8. Housing 4 is made from any material having the required dielectric characteristics.

Proximate ends 10 of base 8 are latch members 12 which project from a top surface 14 of base 8. Each latch member 12 is essentially parallel to ends 10 of base 8 and has a latching projection 16 positioned proximate the top of latch member 12. Latching projections 16 of latch members 12 face each other and cooperate with a daughter printed circuit board 18, as will be discussed. Adjacent latch members 12 are stop members 20 which project from surface 14. Stop members 20 lie in a plane which is essentially perpendicular to the plane of each latch member 12. Proximate the top of stop member 20 is an alignment projection 22 which cooperates with openings 24 in daughter board 18 to ensure daughter borad 18 is properly positioned with respect to connector 2. Pegs 26, 28 extend from a bottom surface 30 of base 8 proximate ends 10 and essentially below latch members 12. As shown in FIG. 1, peg 26 is larger than peg 28 such that pegs 26, 28 cooperate with corresponding holes 31, 32 of a mother board 34, thereby providing a polarizing means between mother board 34 and connector 2, ensuring that connector 2 is properly positioned on board 34.

Figure 2:
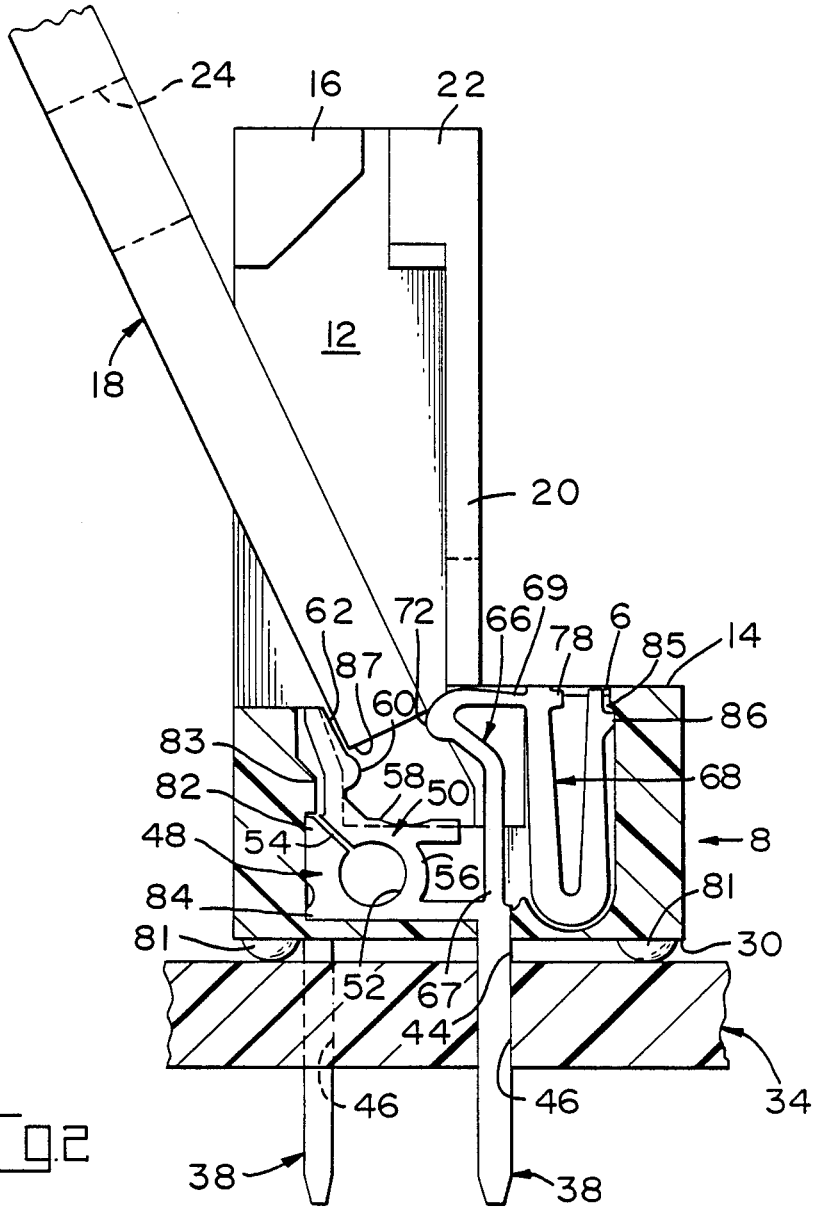
FIG. 2 is a cross-sectional view of the connector showing a daughter board just prior to insertion into a a contact of the connector.
Figure 3:
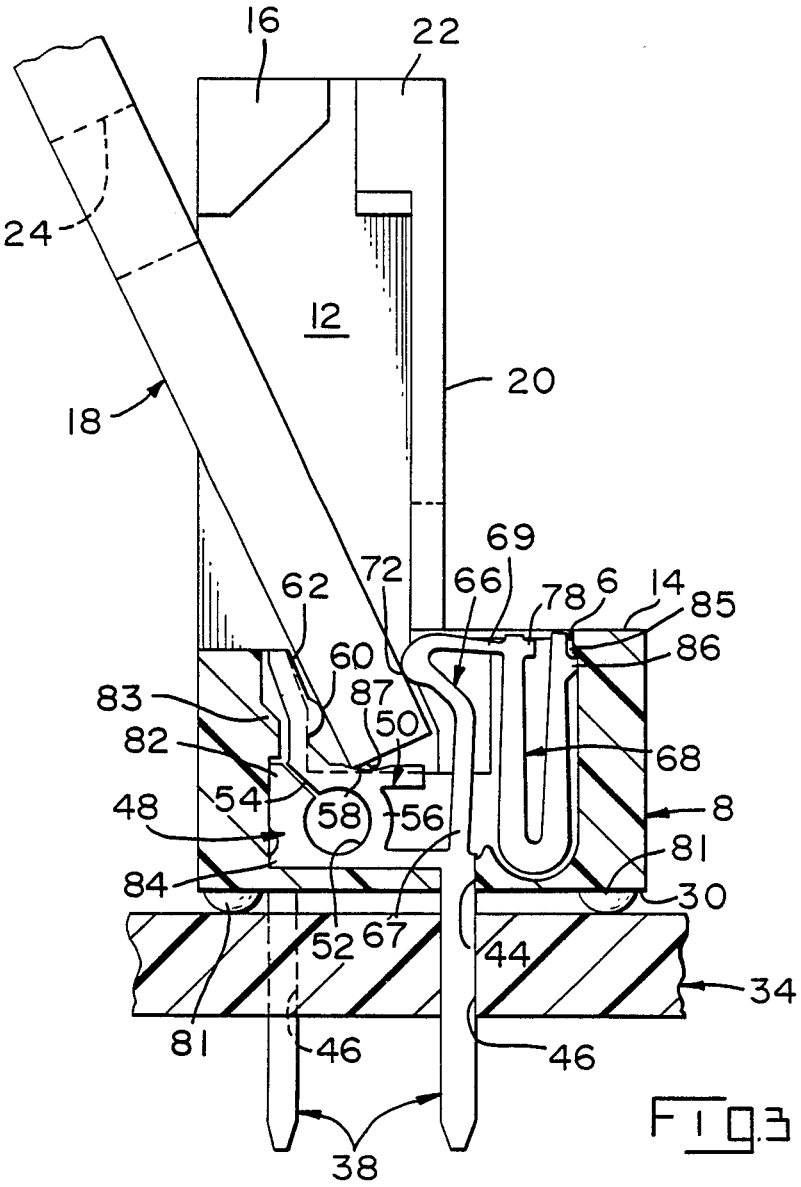
FIG. 3 is a view similar to that of FIG. 2 showing the daughter board inserted into contact but before camming is begun.
Figures 4, 5:
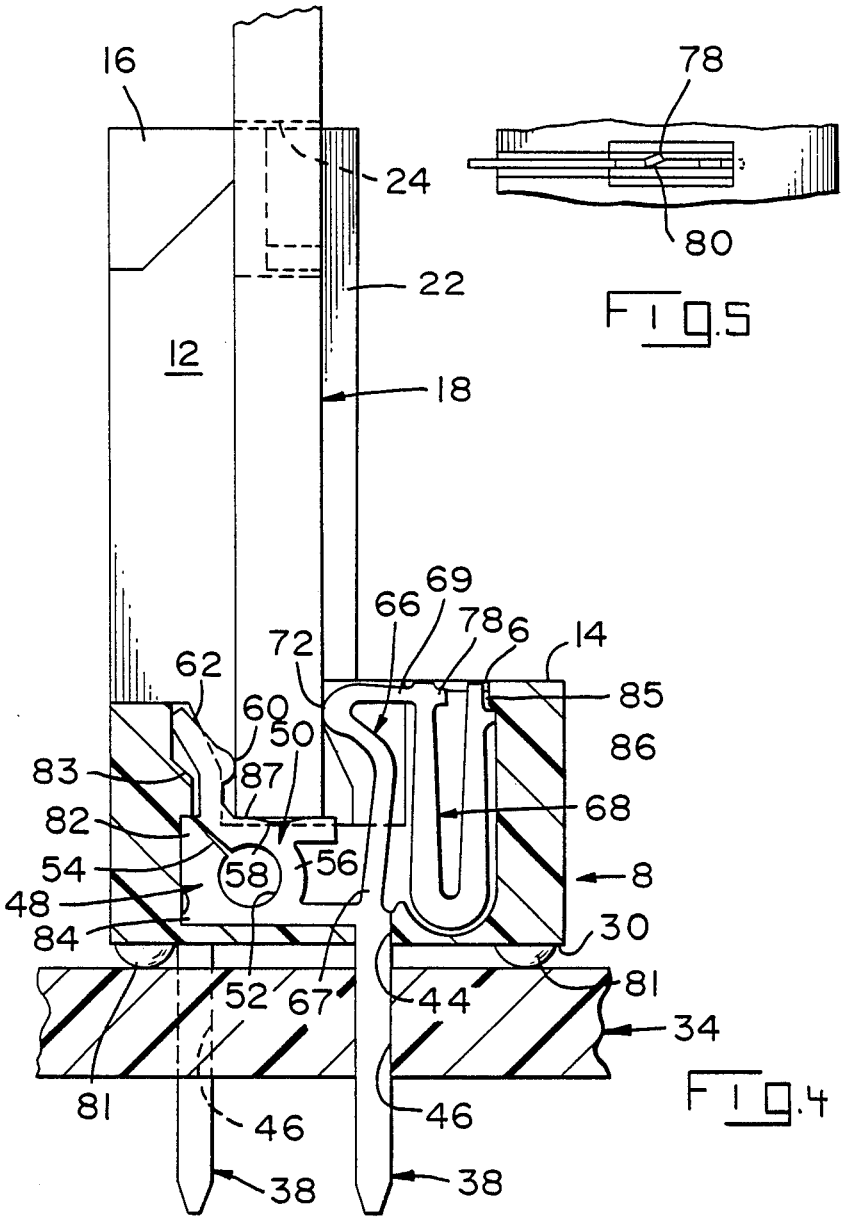
FIG. 4 is a view similar to that of FIG. 2 showing the daughter board in the fully inserted and cammed position.
FIG. 5 is a fragmentary top plan view showing a top of the contact in relationship to openings in a housing of the connector.

A plurality of contact receiving cavities 6, as shown in FIG. 1, are provided in base 8. Cavities 6 extend from top surface 14 of base 8 to proximate bottom surface 30 of base 8, as is best shown in FIGS. 2 through 4. Cavities 6 also extend across base 8, such that cavities are aligned essentially parallel to ends 10. Cavities 6 are in communication with a board-receiving opening 7 in base 8. The exact shape of cavities 6 varies according to the shape of contacts 36 to be secured therein.

A contact 36 is disposed in each contact receiving cavity 6. Each contact 36 is made from sheet metal stock having the desired conductive and resilient characteristics. As shown in FIG. 2, contact 36 is comprised of a post 38, a base 48, a first contact portion 50, a second contact portion 66, and a spring 68.

Contacts 36 are positioned in cavity 6 such that posts 38 extend through an opening 44 in bottom surface 30 of base 8. The lower portions of posts 38 are aligned with corresponding holes 46 of mother board 34 and inserted therein, thereby making an electrical connection between contacts 36 and conductive areas on mother board 34. Proper positioning of posts 38 with respect to holes 46 of mother board 34 is assured because pegs 26, 28 properly align connector 2 with respect to mother board 34. It should be noted that the lower portions of posts 38 may extend horizontally instead of vertically to allow posts 38 to be surface mounted to contact areas of mother board 34.

The upper portions of posts 38 remain in cavities 6 and are connected to base 48. Posts 38 extend from various locations of contacts 36 in order to allow posts 38 to meet the desired centerline spacing requirements and is represented in FIGS. 2 through 4 by posts 38 drawn in phantom and in solid line. This is merely a way of allowing the centerline spacing of posts 38 to be as close as needed. The movement and operation of each contact 36 is not effected by the positioning of posts 38.

The top of each post 38 is integral with some portion of base 48. Bases 48 engage the walls of cavities 6 to help secure and stabilize contacts 36 in cavities 6.

Projecting upward from bases 48 are first contact portions 50. Opening 52 are provided between bases 48 and first contact portions 50. Extending from openings 52 and further separating bases 48 from first contact portions 50 are slots 54. Slots 54 provide the spacing required to permit first contact portions 50 to resiliently move as daughter board 18 is inserted, as will be discussed.

First contact portions 50 are connected to bases 48 by thin arcuate shaped sections 56. The shpe of arcuate sections 56 allows first contact portions 50 to have the desired force and resilient characteristics while using a minimal amount of material to obtain such.

Arcuate camming surfaces 58 are provided on first contact portions 50. Surfaces 58 cooperate with daughter board 18 to provide a positive wipe as daughter board 18 is rotated, as will be discussed. First contact portions 50 have arcuate contact projections 60 which are positioned above arcuate camming surfaces 58 and extend toward the center of cavities 6. Lead in surfaces 62 extend from projections 60 to the top of first contact portions 50. Both surfaces 62 and projections 60 cooperate with daughter board 18 as daughter board 18 is inserted into cavities 6.

First contact portions 50 and in particular thin sections 56 are prevented from overstress by the cooperation of the surfaces of slots 54. The surfaces engage each other before first contact portions 50 can take a permanent set. Consequently, the spring characteristics of first contact portions 50 are protected from abuse and consequently, maintained in proper condition for numerous insertions of board 18..

Second contact portions 66 extend from bases 48 in the same direction as first contact portions 50, as shown in FIGS. 2 through 4. Second contact portions 66 extend from proximate bottom surface 30 of base 8 to proximate top surface 14. Contact projection 72 is provided on portion 66 to cooperate with daughter board 18.

Pivot zones 67, 69 are provided at respective ends of second contact portions 66. The positioning of pivot zones 67, 69 allows portions 66 to provide only minimal resilient forces. The resilient characteristics of contacts 36 are provided by springs 68, which are secured to portions 66 at pivot zones 69. The use of pivot zones 67, 69 allows first contact portions 50 to move independently of second contact portions 66.

For contacts 36 to provide a reliable electrical connection, proper contact force has to be applied by springs 68 in order to ensure that electrical contact is made and maintained between contact projections 60, 72 and contact areas 74 (FIG. 1) of daughter board 18. Springs 68 are U-shaped and are at rest when no daughter board 18 is inserted into connector 2, as is shown in FIG. 2. Overstress members 78 are positioned proximate the tops of one leg of U-shaped springs 68. As springs 68 are forced to compress, members 78 engage the other leg of springs 68, thereby preventing springs 68 from taking a permanent set. Members 86 also insure that springs 68 will not take a permanent set, as members 86 cooperate with walls of cavities 6 to prevent the overstress of springs 68. As viewed in FIG. 5, springs 68 are also prevented from forcing second portion 66 too far into cavities 6. Members 78 of springs 68 cooperate with openings 80 of base 8 such that springs 68 are prevented from opening too far, thereby ensuring that the low insertion force characteristics of connector 2 are maintained.

Projections 82, 84, 86 are at various positions on contacts 36 to cooperate with the walls of cavities 6 to maintain contacts 36 in cavities 6. The manner in which contacts are secured in housing will be more fully discussed below.

Projections 81 extend from bottom surface 30 of base 8 to space base 8 a distance from board 34. This allows the flux to be cleaned from between board 34 and base 8.

Figure 7:
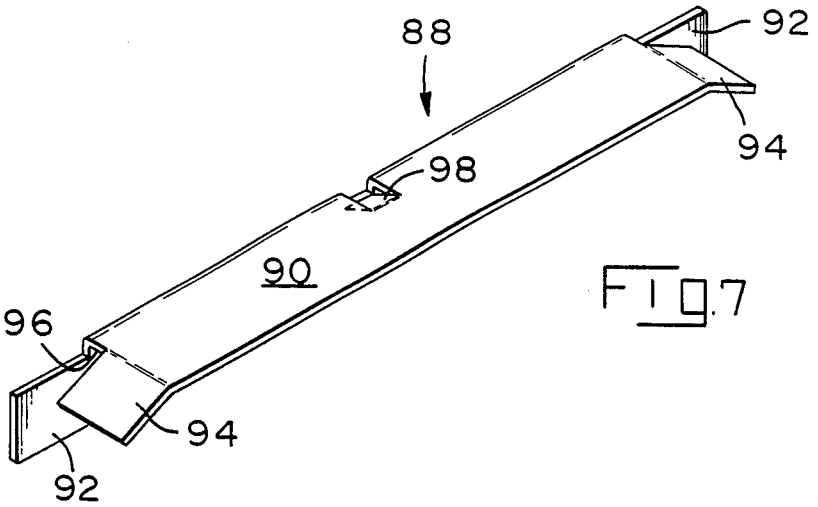
FIG. 7 is a perspective view of a stiffening member of the present invention.
Figure 8:
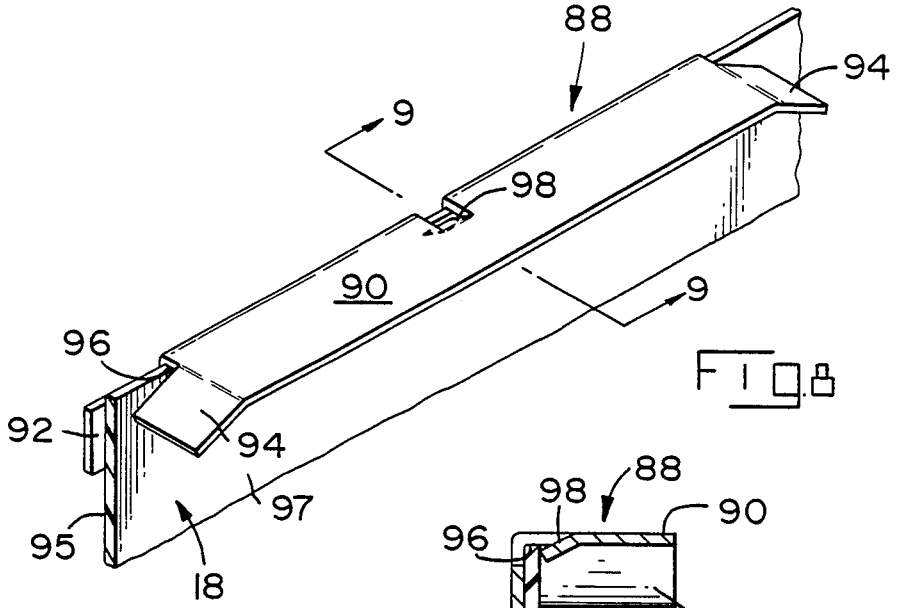
FIG. 8 is a perspective view of the stiffening member in engagement with the daughter board.

A stiffening member 88 is placed on daughter board 18, as shown in FIG. 8. Stiffening member 88 is made from any material having the desired conductive and rigidity characteristics. Stiffening member 88 cooperates with daughter board 18 such that stiffening member 88 acts as a stiffening member and also as a shielding member. As shown in FIG. 7, stiffening member 88 has an elongated top section 90, an elongated side section 92, and two end sections 94.

Side section 92 is positioned adjacent a first surface 95 of daughter board 18. The height of side section 92 varies according to the type of material used. The length of side section 92 corresponds to the length of daughter board 18. Attached to an upper edge of side section 92 is top section 90. Top section 90 has sufficient dimensions to allow top section to extend from first surface 95 beyond second surface 97. Extending from both ends of top section 90 are end sections 94, the plane of end sections 94 being essentially perpendicular to the plane of side sections 92. Slots 96 are formed between end sections 94 and side section 92. The width of slots 96 are essentially equal to or slightly less than the width of daughter board 18 enablng stiffening member 88 to be held on board by interference fit. A latch projection 98 also extends from the center of top section 90 in the same general direction as end sections 94. Latch projection 98 is spaced from side section 92 such that as stiffening member 88 is brought into engagement with board 18, latch projection 98 contacts second surface 97 thereof.

In operation, contacts 36 are positioned in contact receiving cavities 6. Projections 82, 84, 86 of contacts 36 cooperate with the walls of cavities 6 and projections 83, 85 of walls to secure contacts 36 therein. This method of securing contacts 36 to base 8 allows contacts 36 to be movable relative to base 8. This is an important feature because connector 2 is exposed to various temperatures causing it to expand and contract according to its coefficient of expansion. Since contacts 36 are not rigidly secured to connector 2, contacts 36 are not forced to follow the movement of connector 2. Consequently, the movement of connector 2 does not translate into harmful stresses of contact 36.

Figure 9:
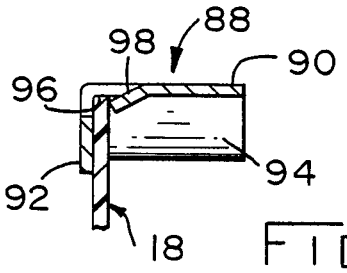
FIG. 9 is a cross-sectional view taken along line 9—9 of FIG. 8 showing the stiffening member in engagement with the daughter board.

Stiffening member 88 is placed on board 18 to prevent board 18 from deforming or bowing due warpage of board 18. Board 18 is slid in slots 96, between side section 92 and latch projection 98 (as shown in FIG. 9), creating an interference fit, maintaining stiffening member 88 on board 18. The rigid characteristics of stiffening member 88 maintain board 18 in a relatively straight manner. Stiffening member 88 may also act as a shielding means. Conductive members (not shown) are positioned at both ends of stiffening member 88 and are electrically connected to contacts 36 of connector 2, providing a shielding means for board 18.

Daughter board 18 is inserted into cavities 6 at an angle, as shown in FIG. 2. This insertion occurs under zero or low insertion force conditions depending on the size of daughter board 18. If the width of daughter board 18 is less than the distance between contact projections 60, 72, the insertion force will be zero. If the width of daughter board 18 is greater than the distance between contact projections 60, 72, the insertion will be under reduced force conditions.

The reduced insertion force conditions occur because the configuration of contacts 36 provides for a low spring rate. The use of spring 68 allows for a shallow force/deflection curve, which means that spring 68 can be deflected with minimal force. In other words, the insertion force required to insert board 18 into cavities 6 is reduced relative to other connectors.

The insertion of daughter board 18 into opening 7 is done at an angle as shown in FIG. 2. Daughter board 18 is inserted into opening 7 until a leading corner 87 of daughter board 18 engages arcuate camming surfaces 58 of first contact portions 50, as shown in FIG. 3. Daughter board 18 is then rotated until daughter board 18 is positioned approximately perpendicular to the plane of mother board 34, as shown in FIG. 4.

As daughter board 18 is rotated, leading corner 87 of daughter board 18 cooperates with arcuate camming surfaces 58 such that the rotating is translated into a vertical motion of daughter board 18 relative to connector 2. This is an important aspect of the invention in that as board 18 is moved vertically, a wiping action occurs between contact projections 60, 72 and contact areas 74 of board 18.

As board 18 is rotated, first and second contact portions 50, 66 are forced toward the walls of cavity 6. Spring 68 is compressed, generating spring forces, which in turn force second contact portions 66 against daughter board 18. The force exerted by springs 68 is great enough to maintain contact projections 72 against daughter board 18, as well as maintain board 18 against contact projections 60. Projections 60 are also exerting a force on board 18 because of the resilient nature of first contact portion 50. Thus, positive electrical connection between projections 60, 72 and contact areas 74 is insured.

Positive electrical connection is also assured because the wipng action of projections 60, 72 and contact areas 74, as discussed above, occurs under increased normal force conditions. As the board 18 is turned, the spring force is increased as wiping continues. Therefore, positive wiping continues until board 18 reaches its parallel position and therefore, wiping occurs when maximum normal force conditions are being reached.

As the fully turned position is approached, daughter board 18 engages latching projections 16. This causes the tops of latch members 12 to be forced toward ends 10 of base 8, allowing board 18 to continue its turning motion. When board 18 is essentially perpendicular to mother board 34, board 18 disengages projections 16, allowing latch members 12 to snap back in place. Board 18 is now secured in perpendicular position between latching projections 16 and stop members 20.

To remove daughter board 18 from connector 2, latch members 12 must be pushed toward ends 10 of base 8 to disengage latching projections from board 18, allowing board 18 to be rotated in the opposite direction of that previously described. Board 18 is returned to the same angle in which it was inserted and removed under the identical zero or reduced force conditions under which it was inserted. Once board 18 is removed, contacts 36 resiliently return to their original position, placing connector 2 in the proper position to repeat the process described.

Figure 6:
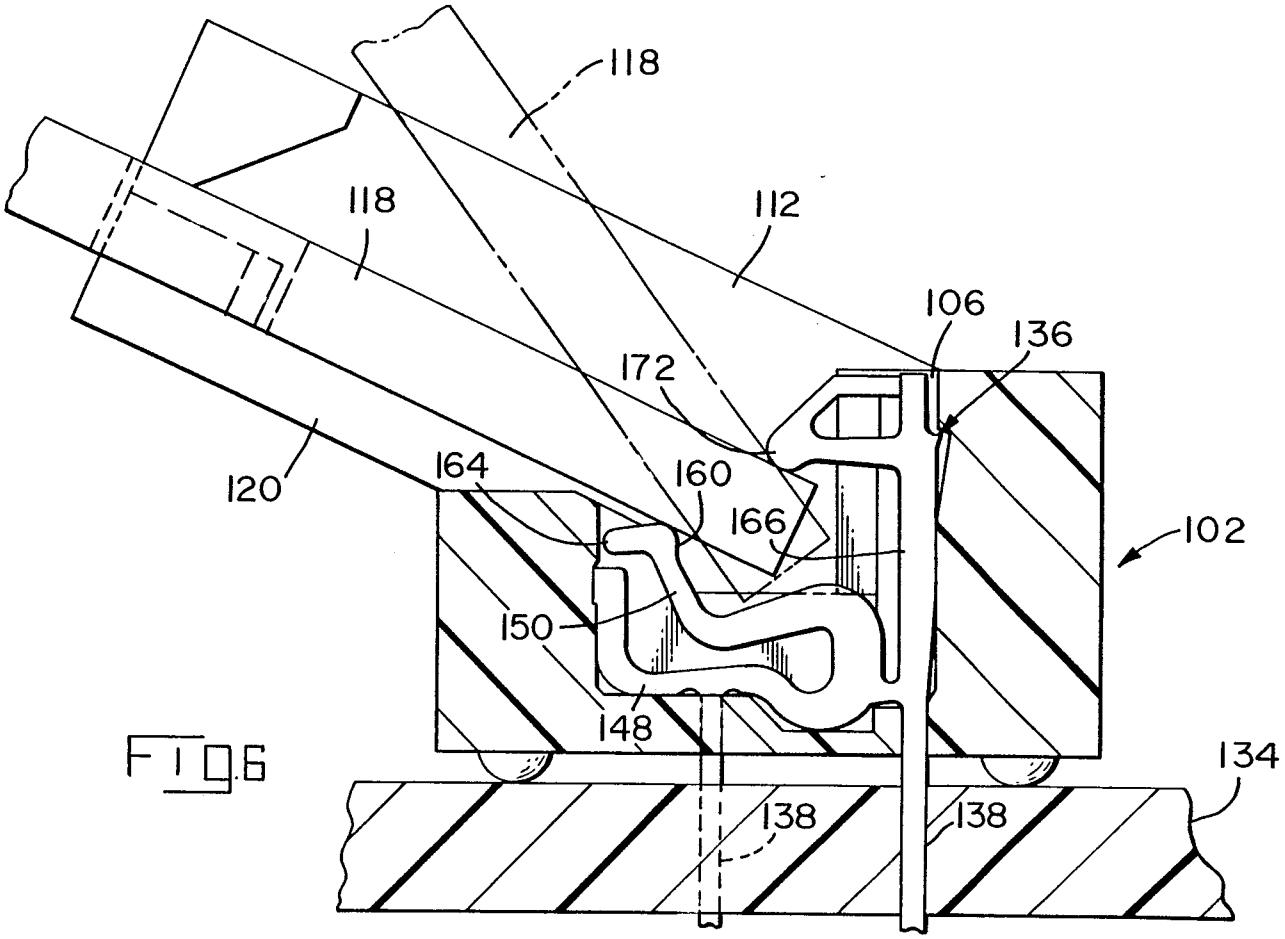
FIG. 6 is a cross-sectional view of an alternative embodiment of the present invention showing, in phantom, a daughter board just prior to insertion into a contact of the connector and in solid line the baby board in the final position.

An alternative embodiment of the invention is shown in FIG. 6. Although the structure of this embodiment varies from that previously described, the function and operation are very similar to the first embodiment.

The difference between the two embodiments is found in the final position of board 118 which is not perpendicular to board 134, but is at an angle (i.e. twenty-five degrees), as shown in FIG. 7. This requires a different configuration of contacts 136. Each contact 136 comprises a post 138, a base 148, a first contact portion 150, and a second contact portion 166. However, the configuration of first and second contact portions 150, 166 does not require the addition of a spring member. First and second contact portions 150, 166 provide the necessary spring force to maintain contact projections 160, 172 in electrical engagement with contact areas 174 of board 118. In order to perform this function, first and second contact portions 150, 166 must be made of sufficient material to allow portions 150, 166 to provide the spring force required for reliable operation.

In operation, daughter board 118 is inserted into the opening of connector 102 which is in communication with cavities 106. Board 118 is then rotated toward mother board 134. As rotation occurs, the spring force of portions 150, 166 force contact projections 160, 172 into engagment with contact areas 174 of daughter board 118. The rotation causes board 118 to move relative to connector 102, causing contact areas 174 of board 118 to move relative to contact projections 160, 172. This movement provides the wiping action necessary to ensure that the surfaces of areas 174 and projections 160, 172 are clear of any film. As board 118 approaches its fully rotated position, latch members 112 and stop members 120 secure board 118 in position, as was previously described. Consequently, a positive electrical connection is affected and maintained.

Removal of daughter board 118 from connector 102 is identical to that of the first embodiment, with the exception that daughter board 118 is rotated in a different direction.

Although the various embodiments have different configurations of the contacts, the overall aspects of the invention remain the same. The board is inserted into the connector under zero or reduced insertion force and rotated untilsecured in place by the latch members. As rotation occurs, the contact projections of the contacts are forced into engagement with the contact areas of the board. Electrical connection is assured because of the wiping action, which occurs under normal force conditions, that is provided between the contact areas and the contact projections.

Although several embodiments of the present invention are described and shown in detail, other embodiments and modifications thereof which could be apparent to one having ordinary skill in the art are intended to be covered by the spirit and scope of the appended claims.

What is claimed is:

1. An electrical connector for electrically connecting contact surfaces of first electrical circuitry to contact areas of second electrical circuitry, the connector comprising:

dielectric housing means having an elongated base, the base having a top surface and a bottom surface;

latching means projecting from opposing ends of the top surface of the base, the latching means cooperating with the first electrical circuitry to latch the first circuitry in a position in which the contact surfaces are in electrical engagement with contacts provided in the housing means;

contact receiving cavities provided in the base, the cavities extending from the top surface toward the bottom surface;

contacts disposed in the contact receiving cavities, the contacts having a first spring contact portion and a second contact portion which is attached to a spring means, the first spring contact portion and the second contact portion having contact means thereon to cooperate with the contact surfaces of the first electrical circuitry, the second contact portion having pivot points positioned at either end thereof, the spring means cooperates with the second contact portion to provide the force required to allow the second contact portion to be maintained in engagement with the contact surface of the first electrical circuitry, the spring means is configured to have a shallow force/deflection curve which allows the spring means to resiliently deflect with only a minimal force applied thereto;

contact portions extending from the contacts through the bottom surface of the housing means in alignment with the contact areas of the second electrical circuitry, such that the contact portions are electrically engageable with the contact areas of the second electrical circuitry;

integral overstress means on the first spring contact portion and the spring means; and integral securing means provided on the first spring contact portion and the spring means, the securing means cooperate with walls of the cavities to retain the contacts in the contact receiving cavities.

2. A connector as recited in claim 1 wherein the contact means of the first spring contact portions and the second contact portions are projections which extend into the cavities.

3. A connector as recited in claim 2 wherein the first electrical circuitry is inserted between the contact means at an acute angle relative to the plane of the bottom surface of the housing means, allowing the circuitry to be inserted under reduced or zero insertion force conditions.

4. A connector as recited in claim 1 wherein the integral overstress means of the spring means are projections, the projections cooperating with the walls of the cavities and portions of the contacts to prevent the the spring means from taking a permanent set.

5. A connector as recited in claim 1 wherein camming means are provided on the first spring contact portions of the contacts, whereby the first electrical circuitry is inserted between the contact means until a leading edge thereof engages the camming means defining a stop position, the first circuitry is then rotated causing the contact means of the contacts to engage the contact surfaces of the first circuitry, such that as rotation continues the camming means causes a positive wiping action to occur, under normal force conditions, between the contact means and the contact surfaces, ensuring that a positive electrical connection is effected.

6. A connector as recited in claim 1 wherein the latching means comprises a resilient latch member anda stop member, the lach member extends from the op surface of the base, the latch member having a latching projection proximate the top thereof, whereby as the first circuitry is rotated the latching projection and stop member cooperate with the first circuitry to define a stop position.

7. A connector as recited in claim 2 wherein the integral overstress means of the spring means comprise projections, the projections cooperate with the walls of the cavities and portions of the contacts to prevent the spring means from taking a permanent set which results from over bending of the spring means.

8. A connector as recited in claim 1 wherein the integral securing means is comprised of projections and recesses which are formed in the contacts, the projections and recesses cooperate with corresponding recesses and projections of the cavities.

9. A connector as recited in claim 1 wherein a support member is mounted on the first circuitry to prevent the first circuitry from bowing or warping when the first circuitry is inserted into the connector.

10. A connector as recited in claim 9 wherein the support member is conductive, cooperating with the contacts, grounding the support member, allowing the support member to act as a shielding member.

11. An electrical contact for connecting contact surfaces of a first printed circuit board to contact areas of a second printed circuit board, the contact comprising:

a base;

an engagement portion for making electrical connection with the contact areas of the second printed circuit board, the engagement portion extending from the base;

a first spring contact portion extending from the base in essentially the opposite direction of the engagement portion, the first spring contact portion having first contact means located thereon;

a second contact portion extending from the base in essentially the same direction as the first spring contact portion, the second contact portion having zones provided at either end thereof, the zones behaving as pivot points, the second portion having second contact means located thereon;

spring means provided proximate the second contact portion, the spring means cooperating with the second contact portion to provide the resilient force required as the first printed circuit board is moved into position between the first contact means and the second contact means, the spring means being configured such that it has a shallow force/deflection curve, which allows the first printed circuit to be inserted between the first and second contact means under reduced insertion force conditions; and integral overstress means on the first spring contact portion and the spring means.

12. An electrical contact as recited in claim 11 wherein the spring means has a U-shaped configuration and has a low spring rate which enables the spring means to maintain its resilient characteristics.

13. An electrical contact as recited in claim 11 wherein camming means are positioned on the first spring contact portion, whereby as the first printed circuit board is inserted between the first spring contact portion and the second contact portion, a leading edge of the first printed circuit board engages the camming means, the camming means and the leading edge cooperating to provide a positive wipe action between the first and the second contact means and the contact surfaces of the first printed circuit board.

14. An electrical contact as recited in claim 11 wherein the overstress means of the spring means comprise projections which extend therefrom, the projections cooperate with walls of a cavity in a dielectric base into which the contact is inserted to prevent the spring means from taking a permanent set.

15. An electrical contact as recited in claim 11 wherein the first and second contact means are projections which extend away from their respective portions, the projections effect electrical connection with the contact surfaces of the first printed circuit board.

16. An electrical contact as recited in claim 11 wherein integral securing means are provided on the contact, the securing means comprising projections and recesses which are formed in the contact, the projections and recesses cooperate with corresponding recesses and projections provided in a cavity in a dielectric base into which the contact is inserted, thereby maintaining the contact therein.

* * * * *